US008783473B1

(12) United States Patent
Schosek

(10) Patent No.: US 8,783,473 B1
(45) Date of Patent: Jul. 22, 2014

(54) FOLDING CLOTHES RACK

(71) Applicant: William O. Schosek, N. Fort Myers, FL (US)

(72) Inventor: William O. Schosek, N. Fort Myers, FL (US)

(73) Assignee: William O. Schosek, N. Fort Myers, FL (US)

( * ) Notice: Subject to any disclaimer, the term of this patent is extended or adjusted under 35 U.S.C. 154(b) by 0 days.

(21) Appl. No.: 13/966,612

(22) Filed: Aug. 14, 2013

(51) Int. Cl.
*A47F 7/00* (2006.01)
*A47G 29/00* (2006.01)

(52) U.S. Cl.
USPC ..... 211/85.3; 211/198

(58) Field of Classification Search
CPC .. A47G 25/0664; A47G 25/0685; A47F 7/24; D06F 57/08
USPC ..... 211/85.3, 85.7, 182, 183, 198, 211/199–204, 206, 191, 189, 195, 85.24, 211/197; 248/165, 166
See application file for complete search history.

(56) References Cited

U.S. PATENT DOCUMENTS

| | | | | | |
|---|---|---|---|---|---|
| 368,238 | A | | 8/1887 | Renner | |
| 1,545,072 | A | | 7/1925 | Stearns | |
| 1,628,936 | A | * | 5/1927 | Turner | 211/119.011 |
| D92,125 | S | * | 5/1934 | Eastman | D34/22 |
| 2,603,272 | A | * | 7/1952 | Rowand | 5/130 |
| 2,634,450 | A | * | 4/1953 | Britton | 15/268 |
| 2,817,522 | A | * | 12/1957 | Margulies | 482/145 |
| 3,249,232 | A | | 5/1966 | Pokorski | |
| 3,276,545 | A | * | 10/1966 | D Angelo | 182/153 |
| 3,483,999 | A | * | 12/1969 | Barrett | 211/204 |
| 3,805,966 | A | * | 4/1974 | Wakeman et al. | 211/182 |
| 3,888,595 | A | * | 6/1975 | Morris | 403/14 |
| 4,129,916 | A | * | 12/1978 | Schlesinger et al. | 14/69.5 |
| 4,256,300 | A | * | 3/1981 | Boucher | 472/118 |
| 4,537,392 | A | * | 8/1985 | Defibaugh | 248/166 |
| 4,752,047 | A | * | 6/1988 | Franks, Jr. | 242/129.6 |
| 4,991,724 | A | * | 2/1991 | Wei | 211/88.04 |
| 5,019,126 | A | | 5/1991 | Post | |
| 5,133,461 | A | * | 7/1992 | Martinell | 211/21 |
| 5,617,962 | A | | 4/1997 | Chen | |
| 6,017,007 | A | * | 1/2000 | Muzzi | 248/163.2 |
| 6,131,749 | A | | 10/2000 | Crockett et al. | |
| 6,234,432 | B1 | * | 5/2001 | Piller et al. | 248/129 |
| 6,958,017 | B1 | * | 10/2005 | Toombs, Jr. | 472/118 |
| 8,342,342 | B1 | | 1/2013 | Vandelaar | |
| 2004/0124160 | A1 | * | 7/2004 | Vitale | 211/40 |
| 2007/0144425 | A1 | * | 6/2007 | Buckley | 114/361 |

* cited by examiner

*Primary Examiner* — Darnell Jayne
*Assistant Examiner* — Hiwot Tefera
(74) *Attorney, Agent, or Firm* — The Livingston Firm; Edward M. Livingston, Esq.; Bryan L. Loeffler, Esq.

(57) ABSTRACT

A triangular folding clothes rack (1) having a top tubular cross piece (2) with an inner axle (3) to allow a front frame (4) of the rack and a rear frame (5) of the rack to fold outward into an open position for drying articles of clothing and inward into a closed position for storing the rack. Clothes may be hung from the top tubular piece and/or hanging rods (9) either directly and/or by using conventional hangers. Offsets (13) located on the rear frame and extensions (14) located on hanging rods allow clothes to be hung without the clothes lying on top of each other, thereby providing maximum air-flow between the clothes to allow for expedited drying.

6 Claims, 3 Drawing Sheets

FOLDING CLOTHES RACK

FIELD OF THE INVENTION

This invention relates to folding clothes racks, and more particularly, a folding clothes rack that allows a user to hang a large amount of clothes either directly on the rack and/or on conventional hangers that are hung on the folding clothes rack without the articles of clothing lying on top of each other, thereby impeding drying.

BACKGROUND OF THE INVENTION

Conventional folding clothes racks typically have an accordion type structure on each side with multiple cross pieces that are horizontal to each side and connect the sides to each other. The accordion type style allows for compact storage when the rack is collapsed and articles of clothing may be folded over the cross pieces for drying when the clothes rack is in an open position. A problem with such conventional folding clothes racks having these accordion type structures is that when articles of clothing are folded over the cross pieces, the articles of clothing on the upper cross pieces generally hang over the articles of clothing on the lower cross pieces. This impedes air flow to the articles of clothing on the lower cross pieces, thereby extending drying time and creating a higher probability the clothes may sour and smell. In addition, the cross pieces are normally close together. Therefore, a user is prevented from hanging clothes on conventional hangers on the cross pieces.

Therefore, a need exists for a folding clothes rack that provides space for hanging clothes either directly on the folding clothes rack and/or on hangers while providing adequate air flow to all of the clothes hung on the rack and a folding clothes rack that is capable of being stored without taking up too much room.

The relevant prior art includes the following references:

(U.S. Patent References)

| Pat. No. | Inventor | Issue/Publication Date |
|---|---|---|
| 368,238 | Renner | Aug. 16, 1887 |
| 1,545,072 | Stearns | Jul. 7, 1925 |
| 3,249,232 | Pokorski | May 3, 1966 |
| 5,019,126 | Post | May 28, 1991 |
| 5,617,962 | Chen | Apr. 8, 1997 |
| 6,131,749 | Crockett et al. | Oct. 17, 2000 |
| 8,342,342 | Vandelaar | Jan. 1, 2013 |

SUMMARY OF THE INVENTION

The primary object of the present invention is to provide a folding clothes rack that provides space for hanging clothes either directly on the folding clothes rack and/or on hangers while providing adequate air flow to all of the clothes hung on the rack.

An additional object of the present invention is to provide a folding clothes rack that is compact when in a closed position so it may be stored without taking up too much room.

The present invention fulfills the above and other objects by providing a triangular folding clothes rack having a top tubular cross piece with an inner axle to allow a front frame of the rack and a rear frame of the rack to fold outward into an open position for drying articles of clothing and inward into a closed position for storage. The front frame and rear frame each have side legs and preferably a bottom cross piece connecting the lower ends of the side legs of the front frame and a bottom cross piece connecting the side legs of the rear frame. One or more hanging rods are located between the legs of the front frame and the legs of the rear frame at predetermined heights to allow multiple hangers and/or direct hanging of clothes for drying. Hangers and clothes may also be hung from the top tubular cross piece. The triangular shape of the folding clothes rack offsets the one or more hanging rods, thereby allowing clothes to be hung on upper hanging rods while being spaced apart from clothes hung on lower hanging rods. This expedites drying time of the clothes.

The top tubular cross piece is preferably located on the front frame. One or more axles are located within the top tubular cross piece. The rear frame has tubular members located at the upper ends of the legs of the rear frame that rotate on the one or more axles, thereby allowing the frame to be folded shut and open. Offsets may also be located below the tubular members to create further distance between the front frame and the rear frame, thereby creating more room for hanging clothes and air flow. One or more stops are preferably located on the legs of the front frame and the legs of the rear frame to prevent the front frame and rear frame from folding outward too far. The present invention is preferably constructed from a tubular material, such as PVC, to allow for easy construction. In addition, the tubular material allows for clothes hangers to be hung more easily and reduces creases in clothes that are hung directly on the rack.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
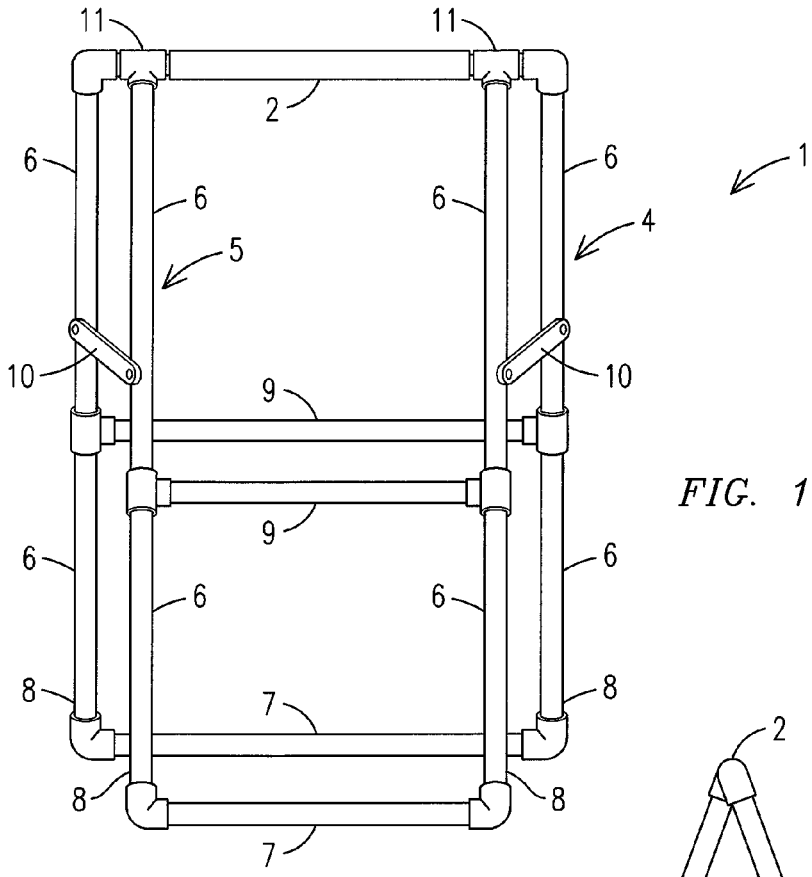
FIG. 1 is a rear view of a folding clothes rack of the present invention.
Figure 2:
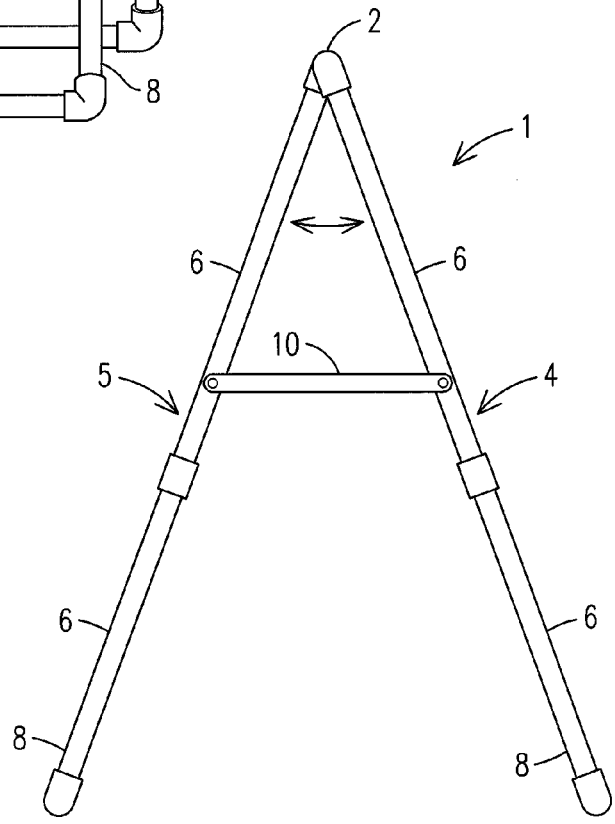
FIG. 2 is a side view of a folding clothes rack of the present invention.
Figure 3:
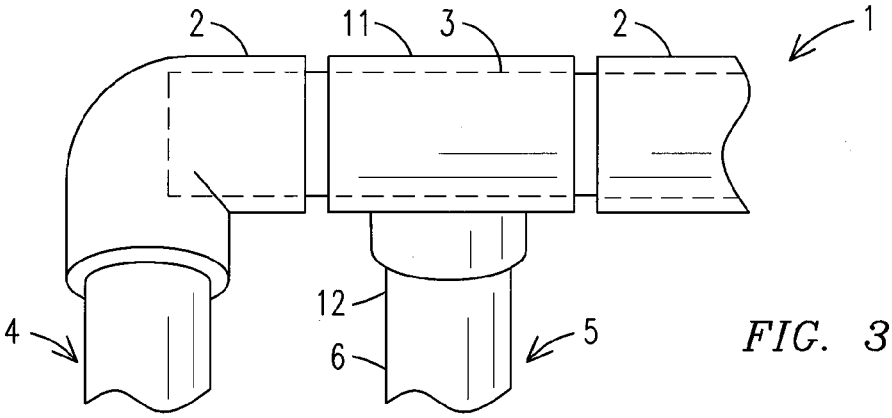
FIG. 3 is a partial front plan view of a rear frame connected to an axle located within the top tubular cross piece.

For purposes of describing the preferred embodiment, the terminology used in reference to the numbered components in the drawings is as follows:

1. folding clothes rack, generally
2. top tubular cross piece
3. axle
4. front frame
5. rear frame
6. leg
7. bottom cross piece
8. lower end of leg
9. hanging rod 10. stop
11. tubular member
12. upper end of leg
13. offset
14. extension With reference to FIGS. 1 and 2, a rear view and a side view, respectively, of a folding clothes rack 1 of the present invention are illustrated. The folding clothes rack 1 comprises a top tubular cross piece 2 with an inner axle 3 (as illustrated in FIG. 3) located inside to allow a front frame 4 of the folding clothes rack 1 and a rear frame 5 of the folding clothes rack 1 to fold outward into an open position, as illustrated here, for drying articles of clothing and inward into a closed flat position for storage in a closet, under a bed and so forth. The front frame 4 and rear frame 5 each have side legs 6 and preferably a bottom cross piece 7 connecting lower ends 8 of the side legs 6 of the front frame 4 and a bottom cross piece 7 connecting the side legs 6 of the rear frame 5. One or more hanging rods 9 are located between the legs 6 of the front frame 4 and the legs 6 of the rear frame 5 at predetermined heights to allow multiple hangers and/or direct hanging of clothes for drying. Hangers and clothes may also be hung from the top tubular cross piece 2. One or more stops 10 are preferably located on the legs 6 of the front frame 4 and the legs 6 of the rear frame 5 to prevent the front frame 4 and rear frame from folding outward too far away from the rear frame 5. The one or more stops 10 may be straps or a rigid material that folds upward when the folding clothes rack is folded into a closed position.

With reference to FIG. 3, a partial front plan view of a rear frame 5 connected to an axle 3 located within the top tubular cross piece 2, is illustrated. The top tubular cross piece 2 preferably located on the front frame 4, which has a width that is greater than the width of the rear frame 5. One or more axles 3 are located within the top tubular cross piece 2. The rear frame 5 comprises tubular members 11 located at upper ends 12 of the legs 6 of the rear frame 5 that rotate on the one or more axles 3, thereby allowing the folding clothes rack 1 to be folded shut and folded open.

Figure 4:
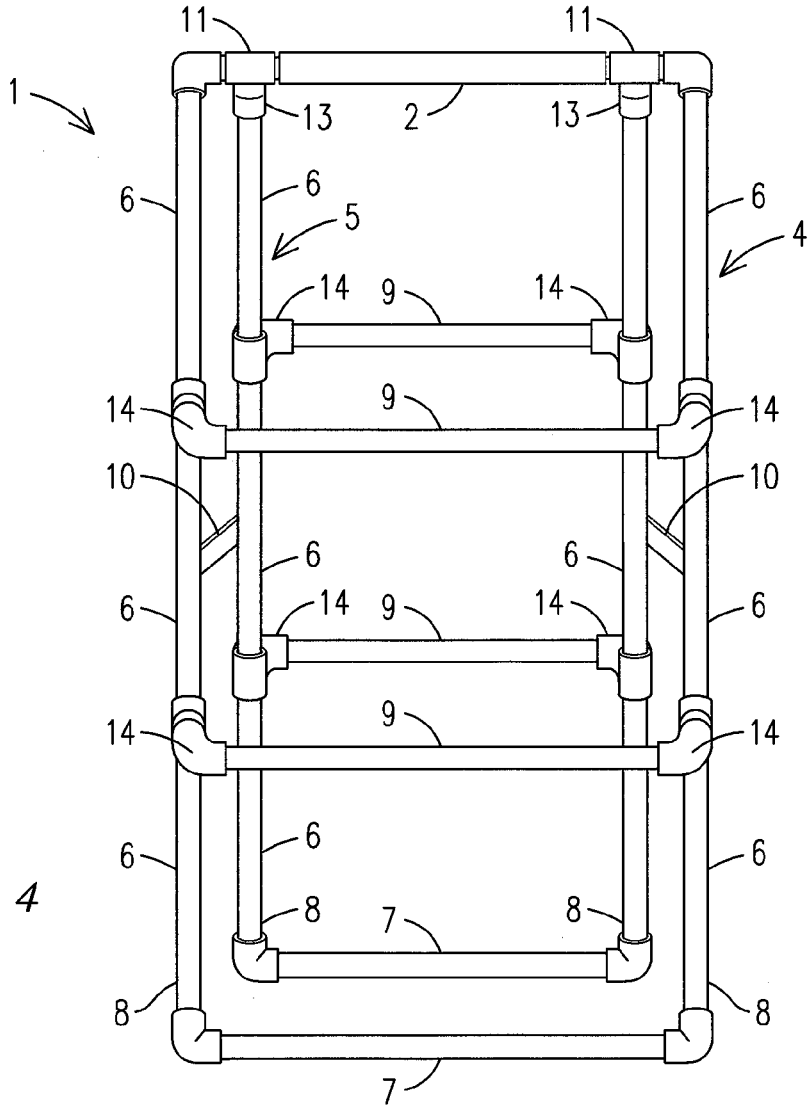
FIG. 4 is a rear view of a folding clothes rack of the present invention having offsets and extended hanging rods.
Figure 5:
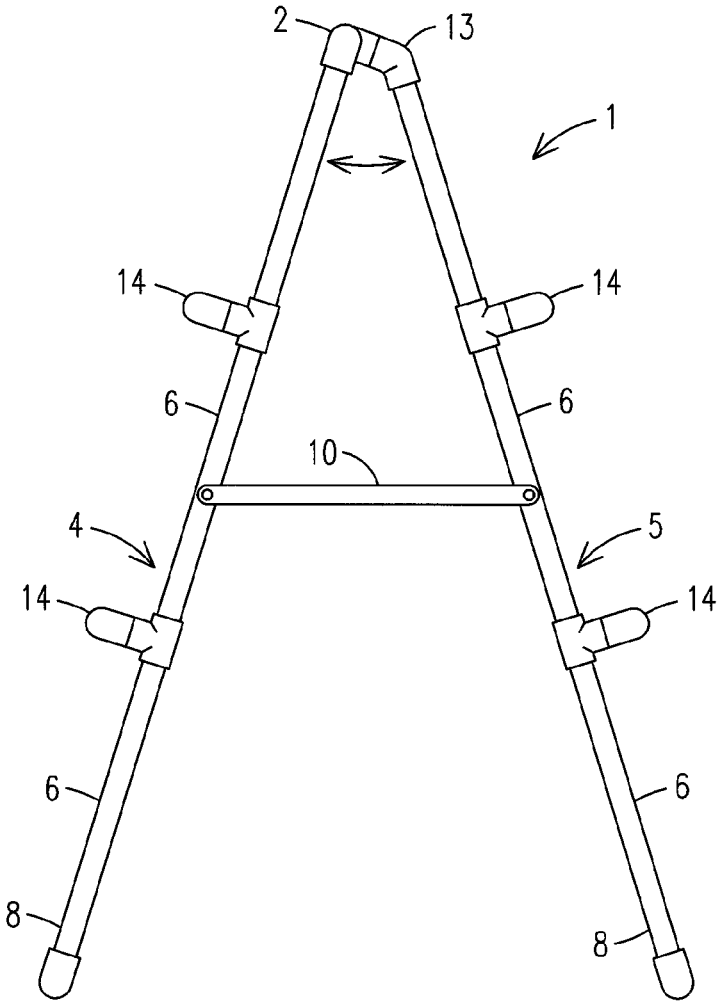
FIG. 5 is a side view of a folding clothes rack of the present invention having offsets and extended hanging rods.
Figure 6:
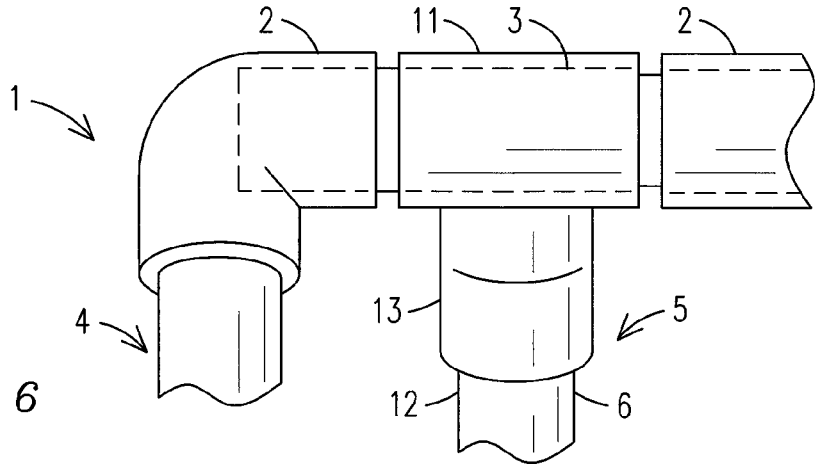
FIG. 6 is a partial front plan view of a rear frame connected to an axle located within the top tubular cross piece having an offset located thereon.

With reference to FIGS. 4 and 5, a rear view and a side view, respectively, of a folding clothes rack 1 of the present invention having offsets 13 and extended hanging rods 9 are illustrated. The folding clothes rack 1 comprises a top tubular cross piece 2 with an inner axle 3 (as illustrated in FIG. 6) located inside to allow a front frame 4 of the folding clothes rack 1 and a rear frame 5 of the folding clothes rack 1 to fold outward into an open position, as illustrated here, for drying articles of clothing and inward into a closed flat position for storage in a closet, under a bed and so forth. The offsets 13 are located below tubular members 11 to create further distance between the front frame 4 and the rear frame 5, thereby creating more room for hanging clothes and air flow. The front frame 4 and rear frame 5 each have side legs 6 and preferably a bottom cross piece 7 connecting lower ends 8 of the side legs 6 of the front frame 4 and a bottom cross piece 7 connecting the side legs 6 of the rear frame 5. One or more hanging rods 9 are located between the legs 6 of the front frame 4 and the legs 6 of the rear frame 5 at predetermined heights to allow multiple hangers and/or direct hanging of clothes for drying. The hanging rods 9 are connected to the side legs 6 by extensions 14 that extend the hanging rods 9 away from the front frame 4 and the rear frame 5, thereby further staggering the clothes for greater air flow. Hangers and clothes may also be hung from the top tubular cross piece 2. One or more stops 10 are preferably located on the legs 6 of the front frame 4 and the legs 6 of the rear frame 5 to prevent the front frame 4 and rear frame from folding outward too far away from the rear frame 5. The one or more stops 910 may be straps, a rigid material that folds upward when the folding clothes rack is folded into a closed position, and so forth.

With reference to FIG. 6, a partial front plan view of a rear frame 5 connected to an axle 3 located within the top tubular cross piece 2 having an offset 13 located thereon, is illustrated. The top tubular cross piece 2 preferably located on the front frame 4, which has a width that is greater than the width of the rear frame 5. One or more axles 3 are located within the top tubular cross piece 2. The rear frame 5 comprises tubular members 11 located at upper ends 12 of the legs 6 of the rear frame 5 that rotate on the one or more axles 3, thereby allowing the folding clothes rack lto be folded shut and folded open. The offsets 13 are located below tubular members 11 to create further distance between the front frame 4 and the rear frame 5, thereby creating more room for hanging clothes and air flow.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A folding clothes rack comprising:

a front frame connected to a rear frame;

a top tubular cross piece located on the front frame having at least one inner axle located inside;

said front frame further comprising at least two legs extending downward;

at least one hanging rod located between the at least two legs of the front frame;

said rear frame further comprising at least two legs extending downward from said at least one inner axle;

at least one hanging rod located between the at least two legs of the rear frame;

tubular members located proximal to upper ends of the at least two legs of the rear frame that rotate on the one or more axles, thereby allowing the folding clothes rack to be folded shut for storage and folded open for use;

tubular offsets located between said tubular members and the upper ends of the at least two legs of the rear frame; and said tubular offsets each defined as a bend to create further distance between the front frame and the rear frame when the folding clothes rack is in an open position for use and to prevent the at least two legs of the rear frame from being perpendicular to the at least one inner axle.

2. The folding clothes rack of claim 1 further comprising:

a bottom cross piece connecting lower ends of the at least two side legs of the front frame.

3. The folding clothes rack of claim 1 further comprising:

a bottom cross piece connecting lower ends of the at least two side legs of the rear frame.

4. The folding clothes rack of claim 1 wherein:

at least hanging rod is connected to the at least two side legs of the rear frame by extensions that extend the at least one hanging rod outward from the rear frame.

5. The folding clothes rack of claim 1 further comprising:

at least one stop located on the front frame and the rear frame to prevent the front frame from folding outward too far away from the rear frame.

6. The folding clothes rack of claim 1 wherein:

at least one hanging rod is connected to the at least two side legs of the front frame by extensions that extend the at least one hanging rod outward from the front frame.

* * * * *